US006749898B2

(12) United States Patent
Nakamura et al.

(10) Patent No.: US 6,749,898 B2
(45) Date of Patent: Jun. 15, 2004

(54) PROCESS FILM FOR USE IN PRODUCING CERAMIC GREEN SHEET AND METHOD FOR PRODUCING THE FILM

(75) Inventors: Toru Nakamura, Saitama (JP); Tomishi Shibano, Saitama (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 09/926,130

(22) PCT Filed: Jan. 16, 2001

(86) PCT No.: PCT/JP01/00228

§ 371 (c)(1),
(2), (4) Date: Sep. 7, 2001

(87) PCT Pub. No.: WO01/53051

PCT Pub. Date: Jul. 26, 2001

(65) Prior Publication Data

US 2003/0027003 A1 Feb. 6, 2003

(30) Foreign Application Priority Data

Jan. 20, 2000 (JP) ..... 2000-011310

(51) Int. Cl.[7] ..... B05D 3/02; B05D 3/06

(52) U.S. Cl. ..... 427/387; 428/480; 428/447; 522/99; 524/357; 524/358; 524/359; 528/15; 528/31; 528/32; 427/515

(58) Field of Search ..... 428/447, 480; 427/387, 515; 522/99; 524/358, 359; 528/15, 31, 32

(56) References Cited

U.S. PATENT DOCUMENTS 4,435,259 A * 3/1984 Chang ..... 522/43
4,603,168 A * 7/1986 Sasaki et al. ..... 522/18
4,916,169 A * 4/1990 Boardman et al. ..... 522/27
4,939,065 A * 7/1990 Cavezzan et al. ..... 430/167
6,046,250 A * 4/2000 Boardman et al. ..... 522/29
6,057,041 A * 5/2000 Sumi et al. ..... 428/447
6,376,569 B1 * 4/2002 Oxman et al. ..... 522/29

FOREIGN PATENT DOCUMENTS

| | | | |
|---|---|---|---|
| EP | 238033 A2 * | 9/1987 | ..... C08L/83/07 |
| EP | 0 559 575 | 9/1993 | |
| JP | 01-098685 | 4/1989 | |
| JP | 05 230436 | 9/1993 | |
| JP | 11-300719 | 11/1999 | |

* cited by examiner

*Primary Examiner*—Margaret G. Moore
*Assistant Examiner*—Marc S Zimmer
(74) *Attorney, Agent, or Firm*—Oblon, Spivak, McClelland, Maier & Neustadt, P.C.

(57) ABSTRACT

There are disclosed a casting film which is used for producing a ceramic green sheet and which comprises a substrate film and a cured layer formed thereon of an addition reaction type silicone composition containing a photosensitizer, in which the cured layer is formed by heat-treating a layer of a photosensitizer-containing addition reaction type silicone composition in a coating amount expressed in terms of solid content in the range of 0.01 to 0.2 g/m$^2$ at a temperature in the range of 40 to 120° C., followed by a treatment with ultraviolet ray irradiation. The casting film is excellent in coatability of ceramic slurry and releasability of ceramic green sheet, and is imparted with high flatness which has heretofore never been realizable by any of conventional casting films.

8 Claims, No Drawings

PROCESS FILM FOR USE IN PRODUCING CERAMIC GREEN SHEET AND METHOD FOR PRODUCING THE FILM

TECHNICAL FIELD

The present invention relates to a casting film for producing a ceramic green sheet and a process for producing the casting film. More particularly, it is concerned with a casting film which is used in producing a ceramic green sheet to be employed in a ceramic capacitor, a laminated inductor element and the like; is equipped with a cured layer of a silicone composition formed thereon having favorable adhesiveness to a substrate film; is excellent in both coatability of ceramic slurry and releasability of the ceramic green sheet; and has high flatness never can be realized by any of conventional film. Furthermore, the present invention is concerned with a process for efficiently producing the above-mentioned casting film.

BACKGROUND ART

Accompanying the market demand in recent years towards miniaturization and weight-saving of electronic equipment in general, the part items constituting the electronic equipment are required to be thin-filmed and lightweight.

For instance, it has come to be possible to miniaturize the electronic part items such as capacitors and laminated inductor elements that have heretofore been part items with leads through practical application of the technology which forms monolithic structure equipped with an internal conductor by simultaneously firing a laminate composed of a ceramic layer and an electro-conductive layer each having a prescribed pattern configuration. Nevertheless still further miniaturization is required.

In general, a ceramic capacitor is produced by the steps of firstly preparing a slurry by mixing ceramic powders having high dielectric constant of a compound, etc. which has perovskite crystalline structure such as barium titanate with a binder or an organic solvent; coating a casting film such as polyethylene terephthalate film with the resultant slurry; drying the coating to prepare ceramic green sheets; then forming an electrode pattern on the ceramic green sheets through screen printing or the like by the use of an electroconductive paste; thereafter releasing the ceramic green sheets from the casting film; then laminating a large number of the printed ceramic green sheets in a prescribed order; press sticking the laminate under heating; cutting the same into chips of desirable shape; and subjecting the chips to firing treatment to proceed with sintering.

On the one hand, in general, a laminated inductor element is produced by at first preparing ceramic green sheets on a casting film in the same manner as the foregoing by the use of magnetic ceramic powders such as ferrite; then forming a coil pattern on the ceramic green sheets through screen printing or the like by the use of an electroconductive paste; releasing the ceramic green sheets from the casting film; and then preparing a laminated inductor element in the shape of chips in the same manner as the foregoing.

The ceramic capacitor and laminated inductor element in the shape of chips thus obtained are required to be still further miniaturized in response to the demand for miniaturization as mentioned above. Accompanying such demand, the thickness of the aforesaid ceramic green sheet being presently in the range of 5 to 20$\mu$m is required to be further small.

As the ceramic green sheet is thinned to such an extent, a conventional casting film is no longer capable of coping with the need, whereby it is indispensable to realize a casting film which is excellent in both coatability of ceramic slurry and releasability of the ceramic green sheet, is free from thermal shrinkage or wrinkle and has extremely high flatness.

There has heretofore been generally employed as a castings film, a polyethylene terephthalate film (PET film) subjected to releasing treatment with a releasing agent composed of a heat curing addition reaction type silicone. However, in order to assure a stable cured film, the releasing agent composed of a heat curable addition reaction type silicone is obliged to be crosslinked at a high temperature of usually 140° C. or higher with the result that the thermal shrinkage of the PET film is inevitably caused in the releasing treatment step. The thermal shrinkage or wrinkle, when being found in the PET film, brings about the problem of making it impossible to form a homogeneous thin film sheet at the time of film forming from ceramic slurry.

Under such circumstances, an attempt is made to carry out processing treatment with a heat curable addition reaction type silicone resin by retarding processing rate at a low temperature (110 to 130° C.) in order to suppress thermal shrinkage or wrinkle to the utmost. However, such attempt brings about the problems of not only poor productivity, but also insufficiency in curing, stability for adhesion of the silicone to the PET film, coatability of ceramic slurry and the like.

There is known, as a releasing agent composed of silicone capable of curing at a low temperature, a releasing agent composed of single ultraviolet ray curable (without heating; the same applies hereinafter) silicone having a functional group such as an epoxy group, acrylic group, mercapto group or the like. Nevertheless such a releasing agent is problematic in that uniform silicone-coated surface is difficult to obtain and besides, the ceramic green sheet is poor in releasability and stability.

DISCLOSURE OF THE INVENTION

In such circumstances, an object of the present invention is to provide a casting film which is used in producing a ceramic green sheet to be employed in a ceramic capacitor, a laminated inductor element and the like; is equipped with a cured layer of silicone composition having favorable adhesiveness to a substrate film; is excellent in coatability of ceramic slurry and releasability of the ceramic green sheet; and has high flatness never can be realized by any of conventional film, and besides a process for efficiently producing the aforesaid casting film.

Other objects of the present invention will be obvious from the text of this specification hereinafter disclosed.

As a result of intensive extensive research and investigation accumulated by the present inventors in order to develop a casting film for producing a ceramic green sheet imparted with the foregoing excellent functions, it has been found that by coating a substrate film in a specific thickness with an addition reaction type silicone composition containing a photosensitizer as a releasing agent, then heat-treating the resultant coating and thereafter curing it by inline ultraviolet ray irradiation, there is formed a cured layer of a silicone composition excellent in adhesiveness to a substrate film, and that the film equipped with the foregoing cured layer is adapted to the objects of the invention as a casting film. The present invention has been accomplished by the above-mentioned findings and information.

That is to say, the present invention provides:

(1) a casting film which is used for producing a ceramic green sheet and which comprises a substrate film and a cured layer coated thereon of an addition reaction type silicone composition containing a photosensitizer, characterized in that said cured layer is formed by heat treating a layer of a photosensitizer-containing addition reaction type silicone composition in a coating amount expressed in terms of solid content in the range of 0.01 to 0.2 g/m$^2$ at a temperature in the range of 40 to 120° C., followed by a treatment with ultraviolet ray irradiation.

(2) the casting film for producing a ceramic green sheet as set forth in the preceding item (1), wherein the substrate film comprises polyethylene terephthalate.

(3) the casting film for producing a ceramic green sheet as set forth in the preceding item (1) or (2), wherein the addition reaction type silicone composition comprises polydimethylsiloxane having a vinyl group as a functional group.

(4) the casting film for producing a ceramic green sheet as set forth in the preceding item (1) or (2), wherein the addition reaction type silicone composition comprises polydimethylsiloxane having a hexenyl group as a functional group.

(5) the casting film for producing a ceramic green sheet as set forth in the preceding item (1) or (2), wherein the addition reaction type silicone composition comprises the mixture of polydimethylsiloxane having a hexenyl group as a functional group and polydimethylsiloxane having a vinyl group as a functional group.

(6) a process which is used for the production of a casting film for producing a ceramic green sheet and which comprises the steps of equipping a substrate film with a photosensitizer-containing addition reaction type silicone composition thereon in a coating amount expressed in terms of solid content in the range of 0.01 to 0.2 g/m$^2$, then heat-treating at a temperature in the range of 40 to 120° C., and irradiating the layer of the silicone composition with ultraviolet ray to cure the layer.

THE MOST PREFERRED EMBODIMENT TO CARRY OUT THE INVENTION

The casting film for producing a ceramic green sheet according to the present invention (hereinafter sometimes referred simply to as "casting film according to the present invention") comprises a substrate film and a cured layer coated thereon of an addition reaction type silicone composition containing a photosensitizer. The above-mentioned substrate film is not specifically limited, but may be properly selected for use from any of the well known films which have heretofore been usable as a substrate film for a casting film for producing a ceramic green sheet. Examples of such films include a polyester film made of polyethylene terephthalate, polyethylene naphthalate or the like, a polyolefin film made of polypropylene, poly-methylpentene or the like, a polycarbonate film and polyvinyl acetate film, Of these, a polyester film is preferable and a biaxially oriented polyethylene terephthalate film is preferable in particular. There is usually used a substrate film having a thickness in the range of 12 to 125 $\mu$m.

The cured layer of the silicone composition to be installed on the above-mentioned substrate film in the casting film according to the present invention is obtained by curing a layer of an addition reaction type silicone composition containing a photosensitizer by the combinational use of a heat treatment and a ultraviolet ray irradiation treatment.

Conventional releasing agents composed of a heat curable addition reaction type silicone have necessitated a high temperature heat treatment for the purpose of achieving a stable cured film. A low temperature heat treatment, when being applied thereto, brings about insufficient curing, thus failing to get favorable performance. As a countermeasure thereagainst, mention is made of an increase in catalyst quantity or a decrease in the rate of processing. However, an increase in catalyst quantity adversely affects the pot life, whereas a decrease in the rate of processing leads to lowered productivity.

As opposed to the foregoing, the present invention provides a casting film which is equipped with a cured layer of a silicone composition having favorable adhesiveness to a substrate film; which has high flatness free from thermal shrinkage or wrinkle; and which is excellent in coatability of ceramic slurry and releasability of the ceramic green sheet, by adding a photosensitizer to the conventional releasing agent composed of a heat curable addition reaction type silicone and using both heat curing and ultraviolet ray curing.

The addition reaction type silicone composition containing a photosensitizer to be used in the present invention is the composition which comprises as principal ingredients, an addition reaction type silicone (for instance, a polydimethyl-siloxane having a functional group) and a crosslinking agent (for instance, a crosslinking agent composed of a silicone resin such as polymetylhydrogen siloxane); a catalyst (for instance, a platinum based catalyst); and a photosensitizer; and optionally as desired, an addition reaction inhibitor, a release modifier such as silicone gum and silicone varnish, and an adhesion improver.

The above-mentioned addition reaction type silicone is not specifically limited, but may be selected for use from a variety of the resins, for instance, those that have heretofore been customarily used as a releasing agent composed of a heat curable addition reaction type silicone. The addition reaction type silicone is exemplified by at least one member selected from polyorganosiloxanes having an alkenyl group as a functional group in a molecule. Preferable examples of the above-mentioned polyorganosiloxanes having an alkenyl group as a functional group in a molecule include polydimethylsiloxane having a vinyl group as a functional group, polydimethylsiloxane having a hexenyl group as a functional group and the mixture of the two. Of these is preferable the polydimethylsiloxane having a hexenyl group as a functional group from the viewpoint of its excellent curability and stable favorable releasability for green sheets being assured.

The crosslinking agent is exemplified by polyorganosiloxane having in its one molecule, at least two hydrogen atoms each bonded to a silicon atom, specifically by dimethylsiloxane/methylhydrogen-siloxane copolymer the end of which is hindered with dimethylhydrogen-siloxy group, dimethylsiloxane/methyl-hydrogen-siloxane copolymer the end of which is hindered with trimethylsiloxy group, poly(methylhydrogen-siloxane) the end of which is hindered with trimethylsiloxy group and poly(hydrogen silsequioxane). The amount of the exemplified crosslinking agent to be used is selected in the range of 0.1 to 100 parts by weight, preferably 0.3 to 50 parts by weight based on 100 parts by weight of the addition reaction type silicone.

Examples of the silicone which has the function of modifying the releasing characteristic of the cured film include polyorganosiloxane not having in its one molecule, an alkenyl group or hydrogen atom each bonded to a silicon atom, specifically, polydimethylsiloxane the end of which is hindered with trimethylsiloxy group and polydimethylsiloxane the end of which is hindered with dimethylphenylsiloxy group.

There is usually employed as a catalyst, a platinum base compound, which is exemplified by platinum in fine powder form, platinum in fine powder form adsorbed on carbon powder carrier, chloroplatinic acid, an alcohol modified chloroplatinic acid, chloroplatinic acid/olefin complex, palladium catalyst and rhodium catalyst. The amount of the above-exemplified catalyst to be used is in the range of 1 to 1000 ppm, approximately based on the total amount of the addition reaction type silicone and the crosslinking agent.

On the one hand, the photosensitizer to be used in the addition reaction type silicone composition is not specifically limited, but may be properly optionally selected for use from those that have heretofore been customarily used in ultraviolet curable resin. Examples thereof include benzoins, benzophenones, acetophenones, α-hydroxy ketones, α-amino-ketones, α-diketones, α-diketone dialkyl acetals, anthraqui-nones, thioxanthones and the other compounds.

The benzoins are exemplified by benzoin, benzoin methyl ether, benzoin ethyl ether, benzoin isopropyl ether, benzoin n-butyl ether, benzoin isobutyl ether and a compound in which benzoin is bonded to both ends of polydimethylsiloxane by ether linkage. The benzophenones are exemplified by benzophenone, p-phenylbenzophenone, 4,4'-diethylaminobenzophenone, dichloro-benzophenone, trimethylsilylbenzophenone and 4-methoxybenzo-phenone. The acetophenones are exemplified by acetophenone, dimethylaminoacetophenone, 3-methylacetophenone, 4-methylaceto-phenone, 4-allylacetophenone, 3-pentylacetophenone and propio-phenone. The α-hydroxy ketones are exemplified by 2-hydroxy-1-(4-isopropyl) phenyl-2-methylpropane-1-one, 2-hydroxy-2-methyl-1-phenylpropane-1-one, 1-[4-(2-hydroxyethoxy)phenyl]-2-hydroxy-2-methylpropane-1-one and 1-hydroxycyclohexylphenyl-ketone. The α-aminoketones are exemplified by 2-methyl-1-[4-(methylthio)-phenyl]-2-morpholinopropane-1-one and 2-benzyl-2-dimethylamino-1-(4-morpholinophenyl)butane-1-one. The α-diketones are exemplified by benzyl and diacetyl. The α-diketone dialkylacetals are exemplified by benzyldimethyl acetal and benzyldiethyl acetal. The anthraquinones are exemplified by 2-methyl anthraqu-inone, 2-ethyl anthraquinone, 2-tert-butyl anthraquinone and 2-amino anthraquinone. The thioxanthones are exemplified by 2-methyl-thioxanthone, 2-ethylthioxanthone, 2-chlorothioxanthone, 2,4-dimethylthioxanthone and 2,4-diethylthioxanthone. The other compounds are exemplified by tertiary amines such a triphenyl-amine and p-dimethylamino benzoic ester, and azo compounds such as azobis(isobutyronitrile).

Any of the above-exemplified photosensitizers may be used alone or in combination with at least one other. The amount thereof to be used is selected in the range of 0.01 to 30 parts by weight, preferably 0.05 to 20 parts by weight based on 100 parts by weight of the total amount of the addition reaction type silicone and the crosslinking agent.

The aforesaid addition reaction inhibitor is a component used for the purpose of imparting the composition with shelf life stability at room temperature, and is specifically exemplified by 3,5-dimethyl-1-hexyne-3-ol, 3-methyl-1-pentene-3-ol, 3-methyl-3-pentene-1-in, 3,5-dimethyl-3-hexene-1-in, cyclic tetravinylsiloxane and benzotriazole.

In the present invention, a coating solution having a viscosity which enables coating is prepared by adding, in a proper organic solvent, the addition reaction type silicone composition containing a photosensitizer together with a variety of components to be used as desired each at a prescribed proportion. The organic solvent is not specifically limited, but may be selected for use from various solvents including for instance, hydrocarbons such as toluene, hexane and heptane, ethyl acetate, methyl ethyl ketone and a mixture thereof.

The coating solution thus prepared according to the present invention is applied to either or both sides of the aforesaid substrate film by means of, for instance, gravure coat method, bar coat method, spray coat method spin coat method, etc. so as to install a layer of the addition reaction type silicone composition containing a photosensitizer in a coating amount expressed in terms of solid content in the range of 0.01 to 0.2 g/m$^2$. The coating amount, when being less than 0.01 g/m$^2$, brings about poor releasability, whereas the coating amount, when being more than 0.2 g/m$^2$, causes deteriorated coatability of ceramic slurry such as the occurrence of repelling at a time of ceramic slurry coating. Taking into consideration the releasability of the ceramic green sheet, coatability of ceramic slurry and the like factors, the coating amount is in the range of preferably 0.05 to 0.12 g/m$^2$, particularly preferably 0.07 to 0.1 g/m$^2$.

The substrate film equipped with the layer of the addition reaction type silicone composition according to the present invention is at first heat-treated at a temperature in the range of 40 to 120° C. to preliminary cure the resultant layer of the addition reaction type silicone resin composition. The heating temperature, when being lower than 40° C., causes a fear of insufficiency in drying or preliminary curing, whereas the heating temperature, when being higher than 120° C., causes thermal shrinkage or wrinkle, thereby failing to attain the objects of the the present invention. Taking into consideration the drying, preliminary curing, thermal shrinkage or wrinkle and the like factors, the heating temperature is preferably in the range of 50 to 100° C.

The layer of the addition reaction type silicone composition which has been preliminary cured by heat treatment is subjected to inline ultraviolet ray radiation to completely cure the layer. Usable ultraviolet lamps are available from previously well known lamps such as high pressure mercury vapor lamp, metal halide lamp, high power metal halide lamp, non-electrode ultraviolet lamp. Of these, non-electrode ultraviolet lamp is preferable from the viewpoints of less thermal damage to the substrate film and favorable curability of the silicone composition layer due to suitable ultraviolet emission efficiency, infrared ray irradiation rate, etc. The foregoing lamp is available from D bulb, R bulb, H+bulb, V bulb and the like manufactured by Fusion Corporation, of which H bulb and H+bulb are particularly preferable. The ultraviolet irradiation output may be properly optionally selected, and is in the range of usually 30 W/cm to 600 W/cm, preferably 50 W/cm to 360 W/cm.

The temperature at the time of ultraviolet irradiation treatment is not specifically limited if carried out inline, but may be either the temperature under heated condition immediately after the heating treatment or room temperature.

The above-mentioned production process enables to obtain the casting film according to the present invention in which the cured layer of addition reaction type silicone composition is formed on either or both sides of the substrate film with favorable adhesiveness thereto, and which is free from thermal shrinkage or wrinkle, imparted with extremely high flatness and besides excellent in coatability of ceramic slurry and releasability of ceramic green sheets.

The casting film according to the present invention is used for producing ceramic green sheets, and is well suited for producing ceramic green sheets having a thickness of preferably 20 μm or less, more preferably 10 μm or less, particularly preferably 6 μm or less.

As ceramic green sheets to which is applicable the casting film according to the present invention, mention is made of the in ceramic green sheet which has a high dielectric constant and is used for a ceramic capacitor in the form of chip, the magnetic green sheet which is used for a laminated inductor element in the form of chip and the like. In particular, it is desirable to apply the casting film according to the present invention to the production of green sheets that are used for a ceramic capacitor for miniaturized portable devices and which has an extremely miniaturized chip size of 1005 form.

As the ceramic which has a high dielectric constant and is contained in ceramic green sheets to be used for a ceramic capacitor, mention is made of a compound having perovskite crystalline structure such as not only barium titanate ($BaTiO_3$) but also $PbTiO_3$, $KNbO_3$, $Pb(Ni2/3Nb_{1/3})O_3$, further $Cd_2Nb_3O_7$, $PbNb_2O_3$ and $PbTa_2O_6$.

On the one hand, as magnetic ceramic contained in ceramic green sheets to be used for laminated inductor elements, mention is made of spinel type ferrite such as Zn base ferrite, Ni base ferrite, Mn base ferrite, Mg base ferrite, Ni—Zn base ferrite, Mn—Zn base ferrite, Mg—Zn base ferrite, Ni—Cu—Zn base ferrite and Mn—Mg—Zn base ferrite, hexagonal system ferrite and the like.

The ceramic green sheets are produced, for instance, by mixing ceramic powder, a proper solvent and a binder such as polyvinyl alcohol base binder, carboxymethyl cellulose base binder, butyral base binder or acrylic binder to prepare a slurry, applying coating of the resultant slurry to the casting film according to the present invention by the use of a doctor knife or the like, and drying treating the coating to form ceramic green sheets each in a thickness of preferably 20 μm or less, more preferably 10 μm or less, particularly preferably 6 μm or less.

The green sheets, when used for a ceramic capacitor, are formed by the use of the aforesaid ceramic powders having a high dielectric constant as ceramic powders, and desirable electrode patterns (internal electrode patterns) are formed on the resultant green sheets through screen printing or the like by the use of an printing electroconductive paste containing metallic electroconductor. The ceramic green sheets are released from the casting films, and laminated in a large number of usually at least 100 sheets, press-stuck under heating, and cut into chips of desirable shape. Subsequently the chips are subjected to firing treatment to proceed with sintering, In this way, a ceramic capacitor is obtained which is equipped with internal electrode and has monolithic structure in the form of chip.

In the case where the green sheets are used for a laminated inductor element, there are formed ceramic green sheets equipped with desirable coil patterns(internal electroconductor patterns) in the same manner as the foregoing by the use of the aforesaid magnetic ceramic powders as ceramic powders, Thereafter by repeating the procedure same as the foregoing, a laminated inductor element is obtained which is equipped with the internal electroconductor and has monolithic structure in the form of chip.

In the following, the present invention will be described in more detail with reference to comparative examples and working examples, which however shall never limit the present invention thereto.

Evaluations were made of the various characteristics of each of the casting films that were obtained through the working examples and comparative examples according to the evaluation procedures as described hereunder.

(1) Curability

Curability was evaluated in accordance with the following criteria by the method comprising vigorously rubbing the surface of a cured coating on a casting film ten times with fingers, and observing the smear and rub-off on the film.

◎: no smear nor rub-off observed at all.

○: slight smear observed (not causing practical problem)

Δ: some smear and rub-off observed (sometimes causing practical problem)

X : marked smear with considerable rub-off observed (causing practical problem)

X X : marked rub-off observed showing insufficient curing (2) Non-migration Property of Silicone Non-migration property of silicone was evaluated in accordance with the following criteria by the method comprising laminating a cured coating on a casting film with a PET film applying a load of 1.97 $N/mm^2$ to the laminate thus formed, allowing the laminate to stand for 24 hours, thereafter peeling the PET film off the laminate, painting the laminated surface with a felt-tipped marker, and observing the extent of repelling to confirm whether silicone was present or not.

◎: no migration observed at all

○: slight migration observed (not causing practical problem)

Δ: some migration observed (sometimes causing practical problem)

X : considerable migration observed (causing practical problem)

X X : marked migration observed (3) Flatness (Thermal Shrinkage or Wrinkle)

Flatness was evaluated in accordance with the following criteria by the method comprising visually observing wrinkle on a casting film, and also coating the cured coating with ceramic slurry in a thickness of 6 μm , and examining whether uniform coating was possible or not.

◎: excellent

○: good ( not causing practical problem)

Δ: somewhat inferior( sometimes causing practical problem)

X : inferior (causing practical problem)

X X : extremely inferior (4) Adhesiveness of Cured Coating (After 70 Days)

Adhesiveness of cured coating was evaluated in accordance with the following criteria by the method comprising vigorously rubbing ten times with fingers, the surface of a cured coating on a casting film after the lapse of 70 days from the treatment with silicone, and observing the rub-off of the cured coating from the PET film.

◎: no rub-off observed at all

○: slight rub-off observed (not causing practical problem)

Δ: some rub-off observed (sometimes causing practical problem)

X : considerable rub-off observed (causing practical problem)

X X : marked rub-off observed (5) Coatability of $BaTiO_3$Slurry and Coatability of Ferrite is Slurry.

By the use of a ball mill, $BaTiO_3$ slurry and ferrite slurry were prepared respectively by mixing and dispersing 100 parts by weight of barium titanate ($BaTiO_3$) powder or Ni—Cu—Zn base ferrite powder, 10 parts by weight of polyvinyl butyral and 10 parts by weight of dibutyl phthalate with the mixed solution of toluene and ethanol which was added thereto. A casting film was uniformly coated with any of the slurries thus obtained so as to attain a coating thickness of 6 μm after drying, and subjected to drying treatment to prepare respective green sheets. Thus coatability of $BaTio_3$ slurry and coatability of ferrite slurry were evaluated in accordance with the following criteria by visually observing the wettability (repelling and unevenness of coating) at the time of slurry coating.

◎: excellent

○: good (not causing practical problem)

Δ: somewhat inferior (sometimes causing practical problem)

X : inferior (causing practical problem)

X X : extremely inferior (6) Releasability of $BaTiO_3$ green sheet and releasability of ferrite green sheet.

Each of the green sheets which were prepared in the same manner as in the preceding item(5) was laminated with a pressure-sensitive adhesive tape(manufactured by Nitto Denko Corporation under the trade name "31B Tape"). Each of the resultant specimens was allowed to stand under the conditions of 23° C. and 65% R. H. for 24 hours, and cut into pieces having a width of 20 mm each. By the use of a tension testing instrument, the casting film of each of the specimens was peeled off the laminate at an angle of 180 degrees at a velocity of 100 meter per minute to measure the force required for peeling (peeling force). In addition, releasability from a releasing film was evaluated in accordance with the following criteria by using the green sheets which were prepared with a coating machine.

◎: excellent

○: good ( not causing practical problem)

Δ: somewhat inferior( sometimes causing practical problem)

X : inferior (causing practical problem)

X X : extremely inferior

Example 1

An addition reaction type silicone composition was prepared by adding 2 parts by weight of a platinum base catalyst (manufactured by Toray Dow corning Silicone Corporation under the trade name "SRX-212") to 100 parts by weight of an addition reaction type silicone as a releasing agent (manufactured by Toray Dow corning Silicone Corporation under the trade name "LTC-760A") comprising as a principal ingredient, polydimethyl-siloxane having hexenyl group as a functional group and a cross-linking agent (polymethylhydrogen siloxane). To 100 parts by weight of the above-mentioned principal ingredient was added one part by weight of acetophenone as a photosensitizer. The mixture prepared in this way was diluted with an organic solvent comprising toluene as a principal ingredient to prepare a coating solution having a solid concentration of one % by weight.

The coating solution was uniformly applied through gravure coat method, to a biaxially oriented PET film having a thickness of 38 μm so as to form a coating thickness of 0.1 μm after drying (coating amount expressed in terms of solid content being 0.1 $g/m^2$). Subsequently the coated PET film was heat-treated for 20 seconds in a hot air circulation type dryer at 50° C., and immediately thereafter was irradiated with ultraviolet ray by the use of a conveyor type ultraviolet irradiating machine equipped with a fusion H bulb of 240 W/cm in which a heat ray cut filter was high diffusion type at a conveyor speed of 40 meter per minute. In this manner, the addition reaction type silicone composition was cured to prepare a casting film. Various characteristics of the resultant film are given in Table 1.

Example 2

The procedure in Example 1 was repeated to prepare a casting film except that the temperature of the hot air circulation type dryer was set on 90° C. instead of 50° C. The performances of the casting film thus obtained were same as those in Example 1. Various characteristics of the resultant film are given in Table 1.

Example 3

An addition reaction type silicone composition was prepared by adding 2 parts by weight of a platinum base catalyst (manufactured by Toray Dow corning Silicone Corporation under the trade name "SRX-212") to 100 parts by weight of an addition reaction type silicone as a releasing agent (manufactured by Toray Dow corning Silicone Corporation under the trade name "SRX-211") comprising as a principal ingredient, polydimethyl-siloxane having vinyl group as a functional group and a cross-linking agent (polymethylhydrogen siloxane). To 100 parts by weight of the above-mentioned principal ingredient was added one part by weight of acetophenone as a photosensitizer. The mixture prepared in this way was diluted with an organic solvent comprising toluene as a principal ingredient to prepare a coating solution having a solid concentration of one % by weight. Thereafter a casting film was prepared in the same manner as in Example 2. The characteristics of the resultant film are given in Table 1.

Example 4

A mixture was prepared by mixing the addition reaction type silicone composition comprising polydimethylsiloxane having vinyl group as a functional group which had been used in Example 3 and the addition reaction type silicone composition comprising polydimethylsiloxane having hexenyl group as a functional group which had been used in Example 1 in a mixing ratio by weight of 1:1. To 100 parts by weight of the above-mentioned principal ingredients was added one part by weight of acetophenone as a photosensitizer. The mixture prepared in this way was diluted with an organic solvent comprising toluene as a principal ingredient to prepare a coating solution having a solid concentration of one % by weight. Thereafter a casting film was prepared in the same manner as in Example 2. The characteristics of the resultant film are given in Table 1.

Comparative Example 1

The addition reaction type silicone resin composition which had been used in Example 3 was diluted with an organic solvent comprising toluene as a principal ingredient to prepare a coating solution having a solid concentration of one % by weight. The coating solution was applied to a biaxially oriented PET film in the same manner as in Example 1, and was heat treated for 30 seconds in a hot air circulation type dryer at 110° C. to prepare a casting film. Various characteristics of the resultant film are given in Table 1.

Comparative Example 2

The procedure in Comparative Example 1 was repeated to prepare a casting film except that the temperature of the hot air circulation type dryer was set on 150° C. instead of 110° C. Various characteristics of the resultant film are given in Table 1.

Comparative Example 3

A conventional ultraviolet curing epoxy ring-opening type silicone comprising polydimethylsiloxane having epoxy group as a functional group as a releasing agent (manufactured by Toshiba Silicone Co. Ltd. under the trade name "UV 9300") was applied to a biaxially oriented PET film. Thereafter without being heat-treated, the coated PET film was subjected to ultraviolet ray irradiation under the conditions same as those in Example 1 so as to cure the silicone as a releasing agent to prepare a casting film. Various characteristics of the resultant film are given in Table 1.

TABLE 1

| | Curability | Non-migration property of silicone | Flatness (thermal shrinkage of wrinkle | Adhesiveness of cured coating (after 70 days | Slurry coatability $BaTiO_3$ | Slurry coatability ferrite | Green sheet $BaTiO_3$ peeling force (mN/20 mm) | Green sheet $BaTiO_3$ releas-ability | Green sheet ferrite peeling force (mN/20 mm) | Green sheet ferrite releas-ability |
|---|---|---|---|---|---|---|---|---|---|---|
| Example 1 | ◎ | ◎ | ◎ | ◎ | ◎ | ◎ | 5.39 | ◎ | 5.49 | ◎ |
| Example 2 | ◎ | ◎ | ◎ | ◎ | ◎ | ◎ | 5.39 | ◎ | 5.49 | ◎ |
| Example 3 | ◎ | ◎ | ◎ | ◎ | ◎ | ◎ | 9.41 | ○ | 9.51 | ○ |
| Example 4 | ◎ | ◎ | ◎ | ◎ | ◎ | ◎ | 5.49 | ◎ | 5.59 | ◎ |
| Comp. Example 1 | Δ | X | Δ | X | X | X | 16.66 | X X | 16.86 | X X |
| Comp. Example 2 | ◎ | ◎ | X X | ◎ | X X | X X | — | — | — | — |
| Comp. Example 3 | ◎ | ○ | ◎ | ○ | X X | X | — | X | — | X |

{Remarks} Comp. Example: Comparative Example

Example 5

The procedure in Example 2 was repeated to prepare a casting film except that the coating amount expressed in terms of solid content was set on 0.04 g/$m^2$ instead of 0.1 g/$m^2$. The results are given in Table 2.

Example 6

The procedure in Example 2 was repeated to prepare a casting film except that the coating amount expressed in terms of solid content was set on 0.06 g/$m^2$ instead of 0.1 g/$m^2$. The results are given in Table 2.

Example 7

The procedure in Example 2 was repeated to prepare a casting film except that the coating amount expressed in terms of solid content was set on 0.12 g/$m^2$ instead of 0.1 g/$m^2$. The results are given in Table 2.

Example 8

The procedure in Example 2 was repeated to prepare a casting film except that the coating amount expressed in terms of solid content was set on 0.20 g/$m^2$ instead of 0.1 g/$m^2$. The results are given in Table 2.

TABLE 2

| | Slurry coatability $BaTiO_3$ | Slurry coatability ferrite | Green sheet releasability $BaTiO_3$ peeling force (mN/20 mm) | Green sheet releasability $BaTiO_3$ releas-ability | Green sheet releasability ferrite peeling force (mN/20 mm) | Green sheet releasability ferrite releas-ability |
|---|---|---|---|---|---|---|
| Example 5 | ◎ | ◎ | 7.84 | ○ | 8.04 | ○ |
| Example 6 | ◎ | ◎ | 5.39 | ◎ | 5.49 | ◎ |
| Example 7 | ◎ | ◎ | 5.39 | ◎ | 5.49 | ◎ |
| Example 8 | ○ | ○ | 5.59 | ◎ | 5.78 | ◎ |

Example 9

The procedure in Example 3 was repeated to prepare a casting film except that the temperature of the hot air circulation type dryer was set on 50° C. instead of 90° C. The results are given in Table 3.

Example 10

The procedure in Example 3 was repeated to prepare a casting film except that the temperature of the hot air circulation type dryer was set on 100° C. instead of 90° C. The results are given in Table 3.

Example 11

The procedure in Example 3 was repeated to prepare a casting film except that the temperature of the hot air circulation type dryer was set on 120° C. instead of 90° C. The results are given in Table 3.

TABLE 3

| | Curability | Flatness (thermal shrinkage or wrinkle) |
|---|---|---|
| Example 9 | ◎ | ◎ |
| Example 10 | ◎ | ◎ |
| Example 11 | ◎ | ○ |

INDUSTRIAL APPLICAILITY

In summarizing the working effect of the present invention, it is made possible to obtain a casting film which is used in producing a ceramic green sheet to be employed in a ceramic capacitor, a laminated inductor element and the lik; which is equipped with a cured layer of a silicone composition having favorable adhesiveness to a substrate film; which is excellent in coatability of ceramic slurry and releasability of the ceramic green sheet; and which has high flatness never can be realized by any of conventional film, by installing on the substrate film, a cured layer of silicone composition through combinational use of heating treatment and ultraviolet irradiation treatment.

What is claimed is:

1. A casting film, comprising:

a substrate film; and a cured layer of an addition reaction type silicone composition comprising (1) a mixture of a polyorganosiloxane having a hexenyl functional group and a polyorganosiloxane having a vinyl functional group, and (2) a photosensitizer;

wherein the cured layer is formed by coating said addition reaction type silicone composition into a layer on the substrate film in an amount of 0.01to 0.2g/$m^2$ in terms of solid content heat-treating said layer at 40 to 120° C., to obtain a heat-treated layer, and then irradiating said heat-treated layer with an ultraviolet ray.

2. The casting film according to claim 1, wherein said polyorganosiloxane is a polydimethylsiloxane.

3. The casting film according to claim 1, wherein said substrate film comprises polyethylene terephthalate.

4. The casting film according to claim 1, wherein said photosensitizer is at least one compound selected from the group consisting of benzoins, benzophenones, acetophenones, αhydroxyketones, α-aminoketones, α-diketones, α-diketone dialkyl acetals, anthraquinones, and thioxanthones.

5. The casting film according to claim 1, wherein said addition reaction silicone composition further comprises a crosslinking agent.

6. The casting film according to claim 5, wherein said crosslinking agent is a polyorganosiloxane having at least two hydrogen atoms bond to silicon atom in one molecule.

7. The casting film according to claim 1, wherein said addition reaction type silicone composition further comprises a platinum-based catalyst.

8. A process for producing a casting film comprising:

coating an addition reaction silicone composition comprising (1) a mixture of a polyorganosiloxane having a hexenyl functional group and a polyorganosiloxane having a vinyl functional group, and (2) a photosensitizer into a layer on a substrate film in an amount of 0.01 to 0.2 g/$m^2$ in terms of solid content;

heat-treating said layer at 40 to 120° C. to obtain a heat-treated layer; and irradiating said heat-treated layer with an ultraviolet ray, thereby curing said heat-treated layer to obtain a cured layer of said addition reaction silicone composition.

* * * * *